US005331610A

United States Patent [19]

Kikuchi

[11] Patent Number: 5,331,610

[45] Date of Patent: Jul. 19, 1994

[54] STRUCTURE FOR CONNECTING A BAND TO A WATCH CASE

[75] Inventor: Tsuyoshi Kikuchi, Tanashi, Japan

[73] Assignee: Citizen Watch Co., Ltd., Tokyo, Japan

[21] Appl. No.: 982,507

[22] Filed: Nov. 27, 1992

[30] Foreign Application Priority Data

Nov. 29, 1991 [JP] Japan ..... 3-105724
Oct. 23, 1992 [JP] Japan ..... 4-079905

[51] Int. Cl.[5] ..... G04B 5/02
[52] U.S. Cl. ..... 368/282; 224/164
[58] Field of Search ..... 368/280–283; 224/164–180

[56] References Cited

U.S. PATENT DOCUMENTS 4,624,581 11/1986 Mock et al. ..... 368/282
4,825,427 4/1989 Wollman ..... 368/282
4,958,334 9/1990 Grosjean ..... 368/282
5,034,932 7/1991 Grosjean ..... 368/286
5,206,841 4/1993 Boucheron ..... 368/276

FOREIGN PATENT DOCUMENTS 60-163390 10/1992 Japan .

*Primary Examiner*—Bernard Roskoski
*Attorney, Agent, or Firm*—Birch, Stewart, Kolasch & Birch

[57] ABSTRACT

A watch case has a bezel and an annular middle, a pair of watch band connecting lugs provided on opposite sides of the bezel and, a pair of ornamental lugs provided on opposite sides of the middle section. The distance between the ornamental lugs is larger than that of the watch band. An end link of the watch band is connected to the connecting lugs, and the bezel and the annular middle section are engaged with each other so as to cover end portions of the end link by the ornamental lugs.

5 Claims, 4 Drawing Sheets

STRUCTURE FOR CONNECTING A BAND TO A WATCH CASE

BACKGROUND OF THE INVENTION

1. Field of the Invention

The present invention relates to a structure for connecting a watch band to a watch case.

2. Discussion of Related Art

Japanese Utility Model Application Laid-Open 60-163390 discloses a structure for connecting a watch band to a rectangular watch case having a bezel and a middle. A pipe is secured to the bezel at a central portion of each side of the bezel, in parallel with the side where the watch band is to be connected. A pair of pipes are secured to the middle at the side corresponding to that of the bezel. A pair of pipes are also secured to an end of the watch band, so that the pair of pipes are disposed outsides of the pair of pipes of the middle. When the bezel is mounted on the middle, the pipe of the bezel is disposed between the pipes of the middle. The pipes of the band are disposed at opposite sides of the pipes of the middle. When all of the pipe portions are thus aligned, a pin is inserted therein to connect the middle and the band together.

In such a connecting structure, the end openings of the holes of the pipes secured to the band are exposed, which deteriorates and effects the appearance of the watch. Moreover, in order to mount the pipe on the middle, the thickness of the middle cannot be decreased very much.

If the thickness of the middle is reduced, the underside periphery of the pipe unsightly projects from the back of the watch case. In order to remove the projection, if the underside of the pipe must be cut off, the end opening becomes a C-shaped form, which is more ugly. It is difficult to hide the opening.

SUMMARY OF THE INVENTION

An object of the present invention is to provide a structure for connecting a band to a watch case with a pin, wherein openings of a hole through which the pin is inserted do not appear, thereby improving the appearance of the watch.

According to the present invention, there is provided a structure for connecting a watch band, having a plurality of links, to a watch case having a bezel for mounting glass and a middle. The structure comprises a pair of band connecting lugs provided on opposite sides of the bezel, each having a through hole in a lateral direction of the band, a pair of ornamental lugs provided on opposite sides of the middle, the distance between the ornamental lugs being larger than that of the band. An end link of the watch band has lateral through holes. The pair of connecting lugs are engaged with the end link of the band, and a connecting member such as a pin, split pin, screw or spring bar is inserted into the through holes of the lugs and the end link to connect the band with the bezel. The bezel is mounted on the middle to dispose the connecting lugs of the bezel and the end link between the ornamental lugs, thereby covering the end link of the band.

In an aspect of the invention, the pair of band connecting lugs are provided on opposite sides of the middle and the pair of ornamental lugs are provided on the opposite sides of the bezel.

In another aspect of the invention, the end link is detachably connected to an adjacent link of the band with an adjustable means such as a screw, hair pin, split pin, and split pipe so that the length of the band can be adjusted.

The through holes for inserting the connecting member are formed only in the band connecting lugs and the link of the band and covered by the ornamental lugs. Thus, the thickness of the ornamental lugs and the middle may be decreased. Since the openings of the through holes are covered, the design for the appearance of the watch can be variously changed.

These and other objects and features of the present invention will become more apparent from the following detailed description with reference to the accompanying drawings.

DETAILED DESCRIPTION OF THE INVENTION

Figure 1:
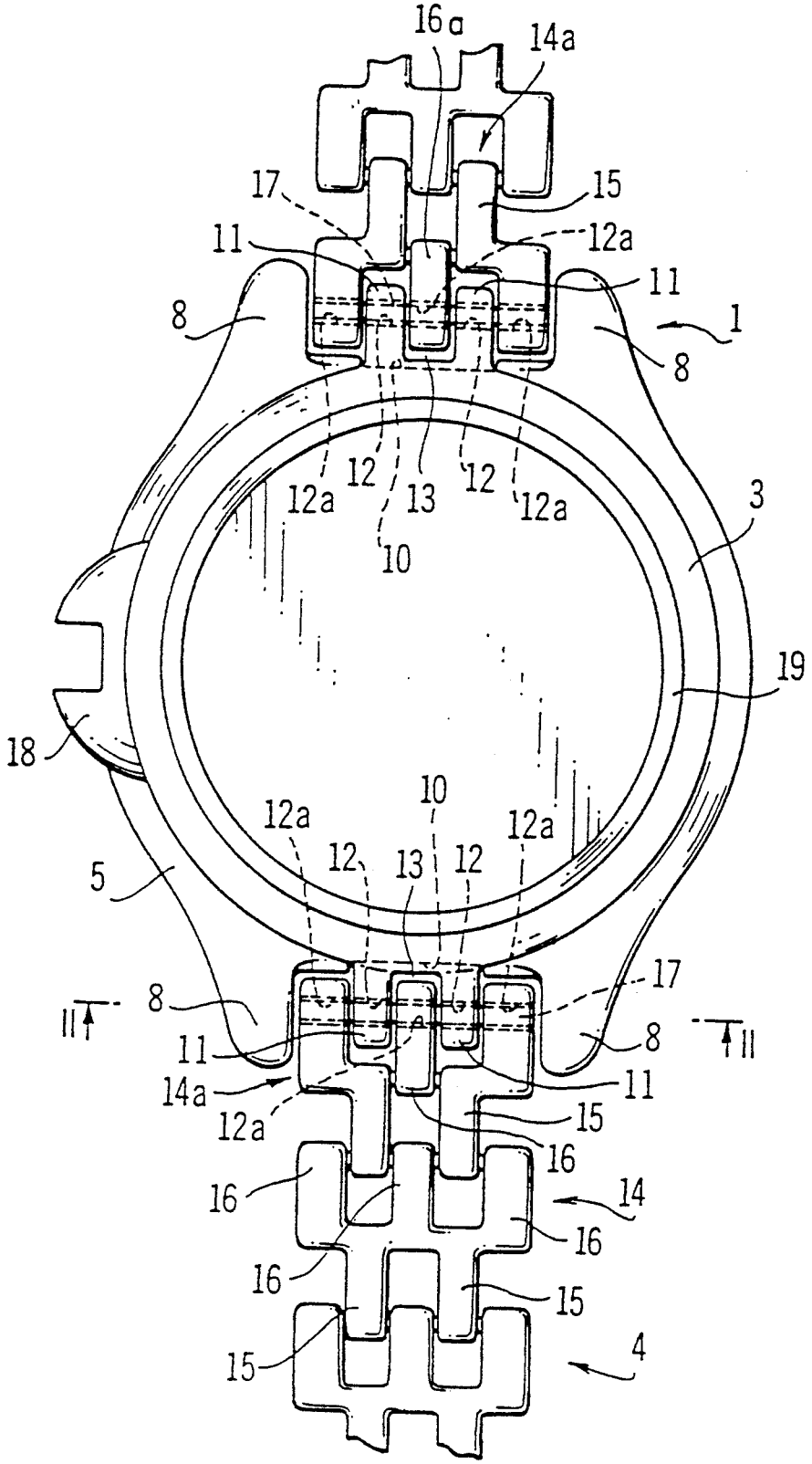
FIG. 1 is a plan view of a watch case and a band of the present invention.
Figure 2:
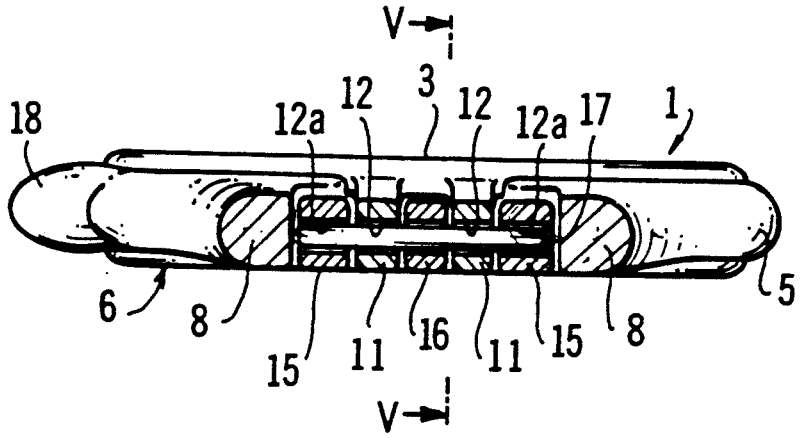
FIG. 2 is a sectional view of the watch case and the band taken along a line II—II of FIG. 1.

Referring to FIGS. 1 and 2, a watch case 1 comprises an annular middle 5 wherein a movement of a watch is mounted, a bezel 3, and a back 6. An end of a band 4 is adapted to be connected to opposite sides of the case 1.

Figure 3:
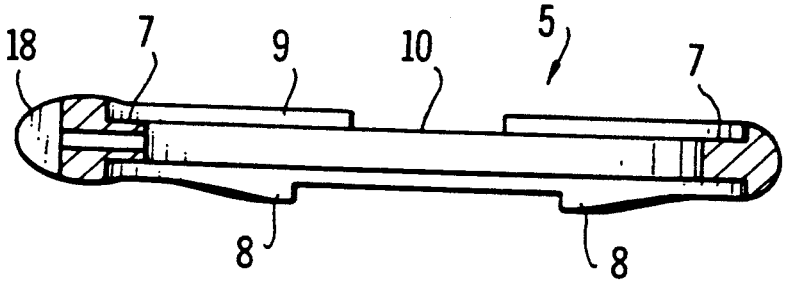
FIG. 3 is a sectional view of a middle of the watch case.

The middle 5 has a crown mounting portion 18 on an outer side periphery thereof. The back 6 is detachably mounted on the underside of the middle 5. Formed on the upper surface of the middle 5 is a stepped portion 7, thereby forming a peripheral annular bulging edge 9 as shown in FIG. 3. A pair of ornamental lugs 8 are further formed on the side periphery of the middle 5 at the band connecting sides thereof where the band 4 is to be connected. The distance between the lugs 8 is slightly larger than the width of the band 4 as shown in FIGS. 1 and 2.

Figure 4:
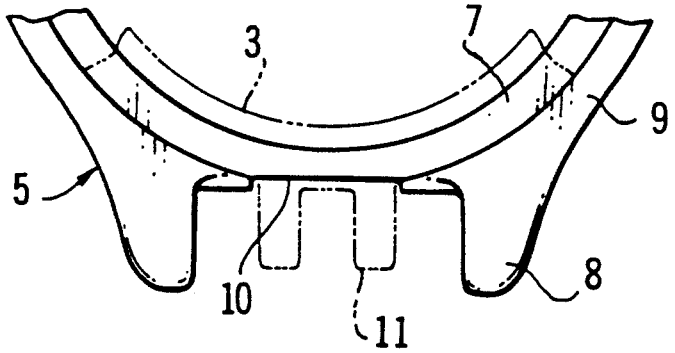
FIG. 4 is a plan view showing a part of the middle.

The upper surface of the annular edge 9 and the peripheral side of the middle 5 are cut away at the band connecting sides so as to form flat positioning grooves 10, as shown in FIG. 4. Each of the positioning grooves 10 is provided for receiving a base portion of the band connecting lugs 11 of the bezel 3, which will be described hereinafter in detail.

Figure 5:
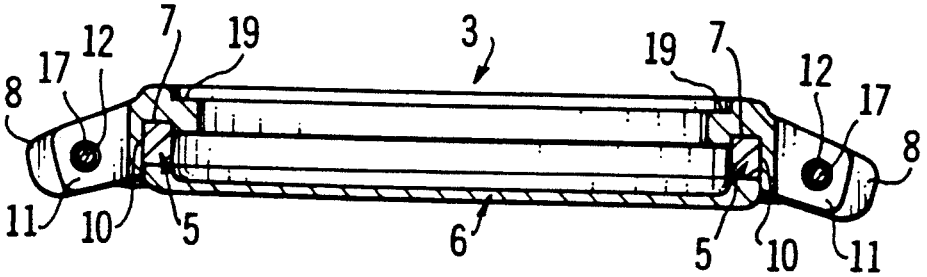
FIG. 5 is a sectional view of the watch case taken along a line V—V of FIG. 2.

Referring to FIGS. 1 and 5, the bezel 3 has a pair of band connecting lugs 11 at band connecting sides, with which the band 4 is connected. The lugs 11 are spaced apart to form a space 13 therebetween. The base portion of the pair of lugs 11 is adapted to fit in the positioning groove 10 of the middle 5. Each lug 11 has a through hole 12 in a direction of the band width, wherein a pin 17 is inserted when attaching the band 4 to the bezel 3. A stepped portion 19 is formed on an upper inner periphery of the bezel for receiving a glass.

As shown in FIGS. 1 and 2, the watch band 4 comprises a plurality of links 14. Each link 14 comprises three projections 16 at one side thereof and two projections 15 at the other side. The two projections 15 are inserted between the three projections 16 and are pivotally connected with each other by a pin (not shown). Each of three projections 16*a* of an end link 14*a* has a through hole 12*a*.

In order to attach the band 4 to the bezel 3, the three projections 16*a* of the end link 14*a* are positioned on opposite sides of the connecting lugs 11 and between the lugs. Namely, the central projection 16*a* of the link 14*a* is disposed in the space 13 between the lugs 11. Thus the through holes 12 and 12*a* of the lugs 11 and the projections 16*a* are aligned. The pin 17 is inserted in the holes 12 and 12*a*, thereby attaching the end link 14*a* to the bezel 3.

The bezel 3 is then mounted on the stepped portion 7 of the middle 5. Each pair of lugs 11 is fitted in the respective positioning groove 10 formed in the middle 5, so that the lug 11 is disposed in a space between the ornamental lugs 8 of the middle 5. Thus the openings of the through holes 12*a* of the projections 16*a* and the pin 17 are blocked from view by the ornamental lugs 8 and hence do not appear. The bezel 3 is thereafter fixed to the middle 5 by laser welding or by staking.

The band 4 is extended by connecting links 14 to the end link 14*a* with pins.

FIGS. 6 to 10 show the second embodiment of the present invention. The second embodiment differs from the first embodiment in that the band is attached to the middle instead of to the bezel.

Figure 6:
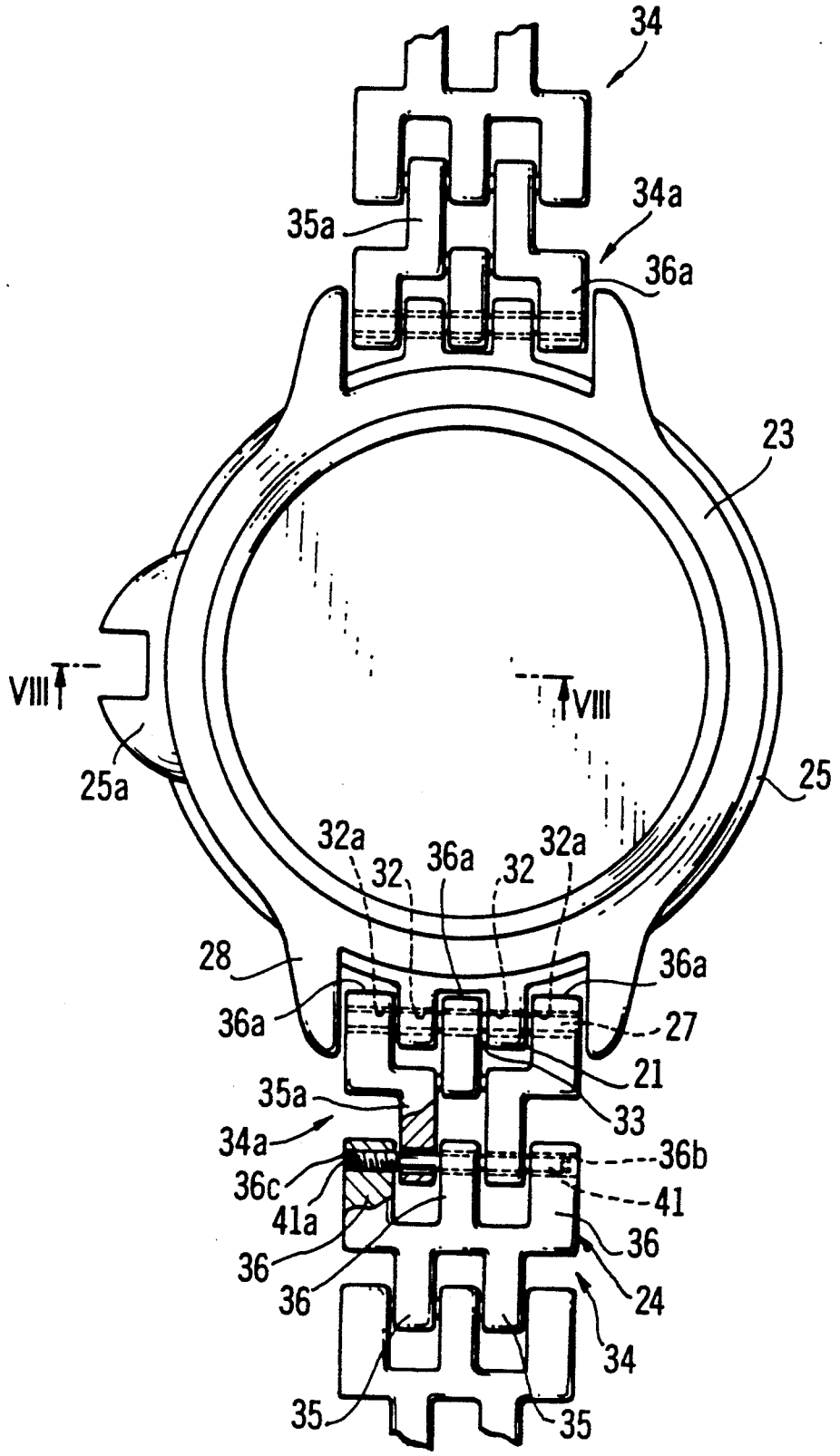
FIG. 6 is a plan view of a watch case and a watch band of a second embodiment of the present invention, with a part of the band cut away.

Referring to FIG. 6, a watch case of the second embodiment comprises a middle 25, a bezel 23 and a back (not shown). An end of a band 24 is adapted to be connected at the band connecting side of the middle 25.

Figure 7:
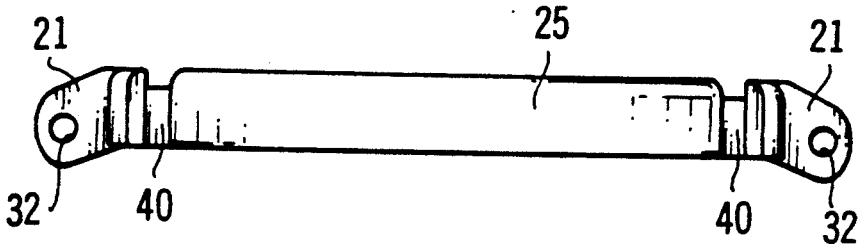
FIG. 7 is a side view of a middle of the watch case of FIG. 6.
Figure 8:
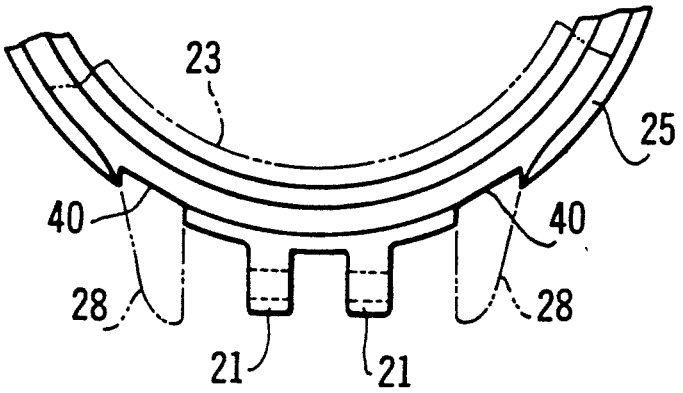
FIG. 8 is a plan view showing a part of the middle.
Figure 9:
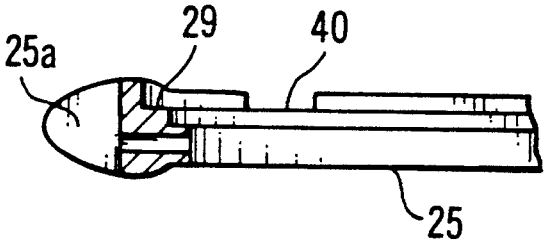
FIG. 9 is a sectional view of a part of the middle case taken along a line VIII—VIII of FIG. 6.

The middle 25 has a crown mounting portion 25*a* and a pair of lugs 21 on the band connecting side. Each pair of lugs 21 is spaced apart to form a space 33 therebetween. As shown in FIG. 7, the lugs 21 protrude downward from the middle 25 so that the underside thereof becomes substantially flush with that of the middle 25. A through hole 32 is formed in each lug 21 in the lateral direction of the band 24. A stepped portion 29, in which the bezel 23 is mounted, is formed on the inner upper portion of the middle 25, as shown in FIG. 9. Four vertical positioning grooves 40 are formed on the outer side periphery of the middle 25 adjacent the lugs 21, as shown in FIGS. 7 and 8.

Figure 10:
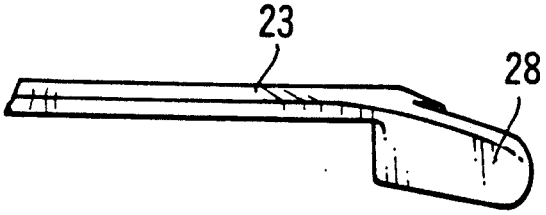
FIG. 10 is a side view showing a part of a bezel of FIG. 6.

Referring to FIGS. 6 and 10, the bezel 23 has a pair of downwardly projecting ornamental lugs 28 at opposite sides. The base portion of the lug 28 is adapted to be engaged with the positioning groove 40 formed in the middle 25. The lugs 28 are spaced apart a distance slightly larger than the width of the band 24. The bezel 23 has a stepped portion (not shown) on an upper inner periphery for receiving a glass.

As shown in FIG. 6, the watch band 24 is similar to the band 4 of the first embodiment and comprises a plurality of links 34 each having three projections 36 and two projections 35. A lateral through hole 32*a* is formed in each projection 36*a* of an end link 34*a*.

To assemble the watch, the projections 36*a* of the end link 34*a* is engaged with the connecting lugs 21 of the middle 25. Namely, the inner projection 36*a* of the link 34*a* is disposed in the recess 33 between the lugs 21. Thus, the through holes 32 and 32*a* of the lugs 21 and the link 34*a* are aligned. A pin 27 is inserted in the holes 32 and 32*a*, thereby attaching the end link 34*a* of the band 24 to the bezel 23.

The bezel 23 is then mounted in the stepped portion 29 of the middle 25. The base portion of each ornamental lug 28 is fitted in the corresponding positioning groove 40 formed on the middle 25. The lugs 21 of the middle 25 are disposed between the ornamental lugs 28 of the bezel 23, so that the openings of the through holes 32*a* and the ends of the pin 27 of the link 34*a* are blocked by the lugs 28. The bezel 23 is thereafter fixed to the middle 25 by laser welding, projection welding, staking or through a packing.

In the present embodiment shown in FIG. 6, a screw 41 having a threaded end portion 41*a* is used to connect another link 34 to the end link 34*a* so that the length of the band 24 can be adjusted. In one of the outer projections 36 of the link 34, a through hole 36*b* is formed. The other projection 36 has a threaded hole 36*c*.

In order to attach the link 34 to the end link 34*a*, the two projections 35*a* of the link 34*a* is inserted between the three projections 36 of the link 34. The screw 41 is inserted from the opening of the hole 36*b* and penetrates through the holes of the intermediate projections 35*a* and 36. The threaded portion 41*a* is engaged with the threaded hole 36*c* and rotated with a screwdriver at the other end (right end of the screw 41 in FIG. 6). Thus, the link 34 is connected to the end link 34*a*.

The present invention may be modified to use a split pin, screw and spring bar instead of the pins 17 and 27 for connecting the end link to the watch case. Similarly, other means such as split pin, split pipe and hair pin may be used to connect the link of the band to the end link so that the length of the band may be changed. The material for the middle and the bezel of the present invention may either be both metal, both plastics, or a combination of metal and plastics.

From the foregoing it will be understood that the present invention provide a structure for connecting a watch band to a watch case wherein a pin and openings of the holes provided in the band and the case are prevented from view by providing ornamental lugs on the case. Thus, a watch having an improved appearance is provided.

While the invention has been described in conjunction with preferred specific embodiments thereof, it will be understood that this description is intended to illustrate and not limit the scope of the invention, which is defined by the following claims.

What is claimed is:

1. A structure for connecting end links of a watch band having a plurality of links to a watch case, said structure comprising:

a watch case including an annular middle section and a bezel for mounting a glass, a pair of band connecting lugs provided on opposite sides of said watch case on one of said bezel and annular middle section, each of said lugs having a through hole in a lateral direction of said band;

a pair of ornamental lugs provided on opposite sides of said watch case on one of said bezel and said annular middle section, a distance between said ornamental lugs being larger than a width of said end links of said band; and a means for connecting said end links of said watch band to said connecting lugs on said opposite sides of said watch case on one of said bezel or said annular middle section, said bezel and annular middle section being engaged with each other such that said means for connecting said end links of said watch band to said connecting lugs of said watch case is hidden from view externally by said ornamental lugs.

2. A structure according to claim 1, wherein said pair of connecting lugs are provided on said bezel and said pair of ornamental lugs are provided on said annular middle section.

3. A structure according to claim 1, wherein said pair of connecting lugs are provided on said annular middle section and said pair of ornamental lugs are provided on said bezel.

4. A structure according to claim 1, further including an adjustable connecting means for connecting an end link of said band with an adjacent link of said band in such a manner that said adjacent link can be disconnected from said end link.

5. A method for connecting a watch band, having a plurality of links to a watch case having a bezel and an annular middle section, said watch case having a pair of band connecting lugs provided on opposite sides of said watch case on one of said bezel and said annular middle section, a pair of ornamental lugs provided on opposite sides of said watch case on one of said bezel and said annular middle section, a distance between said ornamental lugs being larger than a width of said watch band, comprising:

connecting an end link of said watch band to said connecting lugs; and engaging said bezel and said annular middle section with each other so as to cover end portions of said end link by said ornamental lugs.

* * * * *